US008337252B2

(12) United States Patent
Mambakkam et al.

(10) Patent No.: US 8,337,252 B2
(45) Date of Patent: Dec. 25, 2012

(54) SMARTCONNECT FLASH CARD ADAPTER

(75) Inventors: Sreenath Mambakkam, San Jose, CA (US); Arockiyaswamy Venkidu, Menlo Park, CA (US); Larry Lawson Jones, Palo Alto, CA (US)

(73) Assignee: MCM Portfolio LLC, Cupertino, CA (US)

( * ) Notice: Subject to any disclaimer, the term of this patent is extended or adjusted under 35 U.S.C. 154(b) by 0 days.

(21) Appl. No.: 13/225,330

(22) Filed: Sep. 2, 2011

(65) Prior Publication Data

US 2011/0320713 A1 Dec. 29, 2011

Related U.S. Application Data

(63) Continuation of application No. 12/759,550, filed on Apr. 13, 2010, now Pat. No. 8,011,964, which is a continuation of application No. 12/189,725, filed on Aug. 11, 2008, now Pat. No. 7,719,847, which is a continuation of application No. 11/858,086, filed on Sep. 19, 2007, now Pat. No. 7,522,424, which is a continuation of application No. 11/492,556, filed on Jul. 24, 2006, now Pat. No. 7,295,443, which is a continuation of application No. 10/887,635, filed on Jul. 8, 2004, now Pat. No. 7,095,618, which is a continuation-in-part of application No. 10/064,966, filed on Sep. 4, 2002, now Pat. No. 6,859,369, which is a continuation-in-part of application No. 10/167,925, filed on Jun. 11, 2002, now Pat. No. 7,222,205, which is a continuation of application No. 09/610,904, filed on Jul. 6, 2000, now Pat. No. 6,438,638, said application No. 10/064,966 is a continuation-in-part of application No. 10/039,685, filed on Oct. 29, 2001, now Pat. No. 6,832,281, and a continuation-in-part of application No. 10/002,567, filed on Nov. 1, 2001, now abandoned.

(51) Int. Cl.
*H01R 12/00* (2006.01)

(52) U.S. Cl. ..... 439/630

(58) Field of Classification Search ..... 439/630, 439/946, 638, 76.1; 361/796, 752
See application file for complete search history.

(56) References Cited

U.S. PATENT DOCUMENTS

| | | | |
|---|---|---|---|
| 3,821,518 | A | 6/1974 | Miller |
| 3,882,296 | A | 5/1975 | Townsend |
| 4,012,096 | A | 3/1977 | Deluca et al. |
| 4,046,444 | A | 9/1977 | Brorein |

(Continued)

FOREIGN PATENT DOCUMENTS

| | | | |
|---|---|---|---|
| CN | 1278631 | A | 1/2001 |

(Continued)

OTHER PUBLICATIONS

Onspec Electronic, Inc., "Supplementary Search Report for EP Application No. 01952974.2, 3 pages", Sep. 21, 2004.

(Continued)

*Primary Examiner* — Jean F Duverne
(74) *Attorney, Agent, or Firm* — Edward P. Heller, III

(57) ABSTRACT

A multi-memory media adapter to read a plurality of different types of memory media cards. Signals are mapped to the contact pins depending upon the type of memory media card. In one embodiment, a controller connected to an interconnection means maps at least one signal to the contact pins depending upon the type of memory card inserted.

9 Claims, 5 Drawing Sheets

U.S. PATENT DOCUMENTS 4,092,732 A 5/1978 Ouchi
4,131,330 A 12/1978 Stupay
4,264,917 A 4/1981 Ugon
4,275,944 A 6/1981 Sochor
4,327,953 A 5/1982 Slagel et al.
4,392,705 A 7/1983 Andrews, Jr. et al.
4,533,203 A 8/1985 Feldman et al.
4,551,912 A 11/1985 Marks et al.
4,578,573 A 3/1986 Flies et al.
4,579,404 A 4/1986 Lockard
4,591,222 A 5/1986 Shaffer
4,591,950 A 5/1986 Houpt
4,655,526 A 4/1987 Shaffer
4,675,787 A 6/1987 Suwa
4,677,527 A 6/1987 Pasterchick, Jr. et al.
4,684,194 A 8/1987 Jenkins et al.
4,709,136 A 11/1987 Watanabe
4,710,419 A 12/1987 Gregory
4,745,524 A 5/1988 Patton, III
4,756,694 A 7/1988 Billman et al.
4,767,920 A 8/1988 Kitta et al.
4,773,873 A 9/1988 Hillis
4,776,803 A 10/1988 Pretchel et al.
4,781,612 A 11/1988 Thrush
4,799,891 A 1/1989 Reichardt et al.
4,801,561 A 1/1989 Sankhagowit
4,809,326 A 2/1989 Shigenaga
4,811,482 A 3/1989 Moll
4,822,988 A 4/1989 Gloton
4,832,619 A 5/1989 Eck et al.
4,863,395 A 9/1989 Babuka et al.
4,863,402 A 9/1989 Black et al.
4,868,047 A 9/1989 Hasegawa et al.
4,900,273 A 2/1990 Pernet
4,900,903 A 2/1990 Wright et al.
4,938,716 A 7/1990 Chabrolle et al.
4,954,086 A 9/1990 Hill et al.
4,969,842 A 11/1990 Davis
4,975,086 A 12/1990 Reichardt et al.
5,126,548 A 6/1992 Sekiguchi
5,176,523 A 1/1993 Lai
5,184,282 A 2/1993 Kaneda et al.
5,198,645 A 3/1993 Martin et al.
5,200,959 A 4/1993 Gross et al.
5,220,488 A 6/1993 Denes
5,296,692 A 3/1994 Shino
5,297,148 A 3/1994 Harari et al.
5,320,552 A 6/1994 Reichardt et al.
5,336,877 A 8/1994 Raab et al.
5,375,084 A 12/1994 Begun et al.
5,387,131 A 2/1995 Foreman et al.
5,394,206 A 2/1995 Cocca
5,396,617 A 3/1995 Villwock et al.
5,410,677 A 4/1995 Roskowski et al.
D359,724 S 6/1995 Baginy
5,436,621 A 7/1995 Macko et al.
5,437,020 A 7/1995 Wells et al.
5,471,038 A 11/1995 Eisele et al.
5,473,753 A 12/1995 Wells et al.
5,473,765 A 12/1995 Gibbons et al.
5,485,606 A 1/1996 Midgdey et al.
5,486,117 A 1/1996 Chang
5,497,464 A 3/1996 Yeh
5,522,049 A 5/1996 Kimura et al.
5,535,328 A 7/1996 Harari et al.
5,538,436 A 7/1996 Garney
D372,708 S 8/1996 Hetherington
5,561,628 A 10/1996 Terada et al.
5,576,698 A 11/1996 Card et al.
5,584,043 A 12/1996 Burkart
5,589,719 A 12/1996 Fiset
5,594,233 A 1/1997 Kenneth et al.
5,596,562 A 1/1997 Chen
5,596,569 A 1/1997 Madonna et al.
5,596,659 A 1/1997 Normile et al.
5,604,917 A 2/1997 Saito et al.
5,619,660 A 4/1997 Scheer et al.
5,625,534 A 4/1997 Okaya et al.
5,630,174 A 5/1997 Stone et al.
5,640,541 A 6/1997 Bartram et al.
5,649,224 A 7/1997 Scheer
5,663,901 A 9/1997 Wallace et al.
5,671,229 A 9/1997 Harari et al.
5,679,007 A 10/1997 Potdevin et al.
5,680,579 A 10/1997 Young et al.
5,687,592 A 11/1997 Penniman et al.
5,708,799 A 1/1998 Gafken et al.
5,712,472 A 1/1998 Lee
5,717,951 A 2/1998 Yabumoto
5,729,204 A 3/1998 Fackler et al.
5,734,894 A 3/1998 Adamson et al.
5,740,349 A 4/1998 Hasbun et al.
5,748,913 A 5/1998 Shibahara
5,750,973 A 5/1998 Kaufman et al.
5,752,857 A 5/1998 Knights
5,773,901 A 6/1998 Kantner
5,786,769 A 7/1998 Coteus et al.
5,790,878 A 8/1998 Anderson et al.
5,799,171 A 8/1998 Kondou
5,799,200 A 8/1998 Brant et al.
5,802,553 A 9/1998 Robinson et al.
5,805,834 A 9/1998 McKinley et al.
5,815,426 A 9/1998 Jigour et al.
5,818,029 A 10/1998 Thomson
5,828,905 A 10/1998 Rao
5,839,108 A 11/1998 Daberko et al.
5,844,910 A 12/1998 Niijima et al.
5,844,911 A 12/1998 Schadegg et al.
5,846,092 A 12/1998 Feldman et al.
5,847,372 A 12/1998 Kreft
5,877,975 A 3/1999 Jigour et al.
5,877,986 A 3/1999 Harari et al.
5,887,145 A 3/1999 Harari et al.
5,887,488 A 3/1999 Riggle
5,892,213 A 4/1999 Ito et al.
5,905,253 A 5/1999 Ito et al.
5,905,888 A 5/1999 Jones et al.
5,906,516 A 5/1999 Sato et al.
5,909,596 A 6/1999 Mizuta
5,928,347 A 7/1999 Jones
5,928,370 A 7/1999 Asnaashari
5,929,416 A 7/1999 Dos Santos Pato et al.
5,929,427 A 7/1999 Harada et al.
5,930,496 A 7/1999 MacLaren et al.
5,933,328 A 8/1999 Wallace et al.
5,955,722 A 9/1999 Kurz et al.
5,956,473 A 9/1999 Ma et al.
5,961,652 A 10/1999 Thompson
5,964,885 A 10/1999 Little et al.
5,974,426 A 10/1999 Lee et al.
D416,541 S 11/1999 Hirai et al.
5,991,546 A 11/1999 Chan et al.
5,995,376 A 11/1999 Schultz et al.
6,002,605 A 12/1999 Iwasaki et al.
6,006,295 A 12/1999 Jones et al.
6,009,492 A 12/1999 Matsuoka
6,010,066 A 1/2000 Itou et al.
6,011,741 A 1/2000 Wallace et al.
6,015,093 A 1/2000 Barrett et al.
6,026,007 A 2/2000 Jigour et al.
6,038,400 A 3/2000 Bell et al.
6,041,001 A 3/2000 Estakhri
6,061,746 A 5/2000 Stanley et al.
6,062,887 A 5/2000 Schuster et al.
6,067,234 A 5/2000 Kim et al.
6,075,706 A 6/2000 Learmonth et al.
6,079,621 A 6/2000 Vardanyan et al.
6,088,755 A 7/2000 Kobayashi et al.
6,088,802 A 7/2000 Bialick et al.
6,097,605 A 8/2000 Klatt et al.
6,102,715 A 8/2000 Centofante
6,108,730 A 8/2000 Dell et al.
6,109,931 A 8/2000 Yotsutani
6,110,576 A 8/2000 Decker et al.
6,112,014 A 8/2000 Kane
6,122,175 A 9/2000 Shieh
6,132,223 A 10/2000 Seeley et al.

6,134,114 A 10/2000 Ungermann et al.
6,137,710 A 10/2000 Iwasaki et al.
6,139,338 A 10/2000 Hirai et al.
6,145,046 A 11/2000 Jones
6,164,538 A 12/2000 Furuya et al.
6,168,077 B1 1/2001 Gray et al.
6,170,029 B1 1/2001 Kelley et al.
6,170,066 B1 1/2001 See
6,173,291 B1 1/2001 Jenevein
6,173,405 B1 1/2001 Nagel
6,174,188 B1 1/2001 Martucci
6,175,517 B1 1/2001 Jigour et al.
6,176,721 B1 1/2001 Gottardo et al.
6,179,638 B1 1/2001 Lim
6,182,162 B1 1/2001 Estakhri et al.
6,189,055 B1 2/2001 Eisele et al.
6,190,182 B1 2/2001 Liebenow et al.
6,199,122 B1 3/2001 Kobayashi
6,202,932 B1 3/2001 Rapeli
6,203,378 B1 3/2001 Shobara et al.
6,206,710 B1 3/2001 Chen
6,226,202 B1 5/2001 Kikuchi
6,230,226 B1 5/2001 Hu et al.
6,234,844 B1 5/2001 Somerville et al.
6,243,686 B1 6/2001 McPherson et al.
6,246,578 B1 6/2001 Wei et al.
6,247,947 B1 6/2001 Knoernschild et al.
6,261,113 B1 7/2001 Chen
6,264,506 B1 7/2001 Yasufuku et al.
6,266,724 B1 7/2001 Harari et al.
6,279,061 B1 8/2001 Aoki et al.
6,279,069 B1 8/2001 Robinson et al.
6,282,612 B1 8/2001 Sakajiri et al.
6,283,376 B1 9/2001 Schuder et al.
6,285,555 B1 9/2001 O'Neal et al.
6,292,863 B1 9/2001 Terasaki et al.
6,307,538 B1 10/2001 Bacon
6,311,290 B1 10/2001 Hasbun et al.
6,315,207 B1 11/2001 Eisele et al.
6,315,582 B1 11/2001 Nishio et al.
6,317,352 B1 11/2001 Halbert et al.
6,330,688 B1 12/2001 Brown
6,337,712 B1 1/2002 Shiota et al.
6,352,445 B2 3/2002 Takei et al.
6,353,870 B1 3/2002 Mills et al.
6,378,015 B1 4/2002 Yen
6,381,513 B1 4/2002 Takase et al.
6,381,662 B1 4/2002 Harari et al.
6,385,667 B1 5/2002 Estakhri et al.
6,385,677 B1 5/2002 Yao
6,386,920 B1 5/2002 Sun
6,390,855 B1 5/2002 Chang
6,393,524 B1 5/2002 Ayers
6,402,259 B2 6/2002 Corio et al.
6,402,529 B2 6/2002 Saito et al.
6,402,558 B1 6/2002 Hung-Ju et al.
6,404,323 B1 6/2002 Schrum et al.
6,405,323 B1 6/2002 Lin et al.
6,408,352 B1 6/2002 Hosaka et al.
6,412,080 B1 6/2002 Fleming et al.
6,426,801 B1 7/2002 Reed
6,427,186 B1 7/2002 Lin et al.
6,438,638 B1 8/2002 Jones et al.
6,442,734 B1 8/2002 Hanson et al.
6,456,491 B1 9/2002 Flannery et al.
6,457,647 B1 10/2002 Kurihashi et al.
6,460,094 B1 10/2002 Hanson et al.
6,468,101 B2 10/2002 Suzuki
6,470,284 B1 10/2002 Oh et al.
6,471,130 B2 10/2002 Iwasaki
6,477,604 B1 11/2002 Chen
6,482,029 B2 11/2002 Nishimura
6,490,163 B1 12/2002 Pua et al.
6,496,381 B1 12/2002 Groeger
6,519,739 B1 2/2003 Sandorfi
6,522,552 B1 2/2003 Lee
6,523,079 B2 2/2003 Kikinis et al.
6,523,132 B1 2/2003 Harari et al.
6,524,137 B1 2/2003 Liu et al.
6,532,152 B1 3/2003 White et al.
6,535,997 B1 3/2003 Janson et al.
6,540,523 B1 4/2003 Kung et al.
6,557,754 B2 5/2003 Gray et al.
6,561,421 B1 5/2003 Yu
6,567,875 B1 5/2003 Williams et al.
6,568,960 B2 5/2003 Bricaud et al.
6,570,767 B1 5/2003 Vapaakoski et al.
6,578,125 B2 6/2003 Toba
6,581,830 B1 6/2003 Jelinek et al.
6,595,803 B2 7/2003 Akagi et al.
6,599,147 B1 7/2003 Mills et al.
6,601,124 B1 7/2003 Blair
6,607,405 B2 8/2003 Nishimura
6,607,707 B2 8/2003 Reichman et al.
6,612,492 B1 9/2003 Yen
6,612,498 B1 9/2003 Lipponen et al.
6,628,524 B1 9/2003 Washino et al.
6,641,413 B2 11/2003 Kuroda
6,642,614 B1 11/2003 Chen
6,651,149 B1 11/2003 Iwasaki
6,654,841 B2 11/2003 Lin
6,658,202 B1 12/2003 Battaglia et al.
6,658,516 B2 12/2003 Yao
6,658,638 B2 12/2003 Shau
6,661,454 B1 12/2003 Hwang et al.
6,663,007 B1 12/2003 Sun et al.
6,666,724 B1 12/2003 Lwee
6,668,077 B1 12/2003 Ohkubo
6,669,487 B1 12/2003 Nishizawa et al.
6,675,233 B1 1/2004 Du et al.
6,681,991 B1 1/2004 Li
6,684,283 B1 1/2004 Harris et al.
6,687,778 B2 2/2004 Ito et al.
6,688,521 B2 2/2004 Cheng
6,699,053 B2 3/2004 Kuroda
6,699,061 B2 3/2004 Abe et al.
6,701,058 B1 3/2004 Tsubaki
6,705,529 B1 3/2004 Kettunen et al.
6,718,274 B2 4/2004 Huang et al.
6,722,572 B2 4/2004 Ono et al.
6,725,286 B2 4/2004 Takahashi
6,725,291 B2 4/2004 Lai et al.
6,735,720 B1 5/2004 Dunn et al.
6,738,259 B2 5/2004 Le et al.
6,745,267 B2 6/2004 Chen et al.
6,746,280 B1 6/2004 Lu et al.
6,751,694 B2 6/2004 Liu et al.
6,754,765 B1 6/2004 Chang et al.
6,761,313 B2 7/2004 Hsieh et al.
6,761,320 B1 7/2004 Chen
6,771,322 B1 8/2004 Neifer
6,780,062 B2 8/2004 Liu et al.
6,792,501 B2 9/2004 Chen et al.
6,806,559 B2 10/2004 Gann et al.
6,808,424 B2 10/2004 Kaneshiro et al.
6,820,148 B1 11/2004 Cedar et al.
6,824,063 B1 11/2004 Wallace et al.
6,830,474 B2 12/2004 Liu et al.
6,832,281 B2 12/2004 Jones et al.
6,836,885 B1 12/2004 Buswell et al.
6,839,864 B2 1/2005 Mambakkam et al.
6,842,818 B2 1/2005 Okamoto et al.
6,857,907 B1 2/2005 Hung et al.
6,859,361 B1 2/2005 Mambakkam et al.
6,859,369 B2 2/2005 Mambakkam et al.
6,863,572 B1 3/2005 Yi et al.
6,880,024 B2 4/2005 Chen et al.
6,886,057 B2 4/2005 Brewer et al.
6,901,457 B1 5/2005 Toombs et al.
6,915,956 B2 7/2005 Liu et al.
6,920,517 B2 7/2005 Mills et al.
6,941,405 B2 9/2005 Morrow
6,945,461 B1 9/2005 Hien et al.
6,973,535 B2 12/2005 Bruner et al.
6,984,152 B2 1/2006 Mowery et al.
7,000,054 B2 2/2006 Kwong et al.
7,019,778 B1 3/2006 Prabhu et al.
7,020,739 B2 3/2006 Mukaida et al.

| | | | | |
|---|---|---|---|---|
| 7,033,221 | B2 | 4/2006 | Bricaud et al. | |
| 7,036,738 | B1 | 5/2006 | Vanzini et al. | |
| 7,038,665 | B1 | 5/2006 | Pandana | |
| 7,038,696 | B2 | 5/2006 | Emerson et al. | |
| 7,062,584 | B1 | 6/2006 | Worrell et al. | |
| 7,065,591 | B2 | 6/2006 | Han et al. | |
| 7,093,161 | B1 | 8/2006 | Mambakkam et al. | |
| 7,095,618 | B1 | 8/2006 | Mambakkam et al. | |
| 7,107,378 | B1 | 9/2006 | Brewer et al. | |
| 7,114,659 | B2 | 10/2006 | Harari et al. | |
| 7,114,993 | B2 * | 10/2006 | Chen | 439/630 |
| 7,126,926 | B1 | 10/2006 | Bjorklund et al. | |
| 7,152,801 | B2 | 12/2006 | Cuellar et al. | |
| 7,162,547 | B2 | 1/2007 | Hosaka et al. | |
| 7,162,549 | B2 | 1/2007 | Mambakkam et al. | |
| 7,177,975 | B2 | 2/2007 | Toombs et al. | |
| 7,191,270 | B2 | 3/2007 | Oh et al. | |
| 7,206,970 | B1 | 4/2007 | Lauterbach et al. | |
| 7,222,205 | B2 * | 5/2007 | Jones et al. | 710/301 |
| 7,231,643 | B1 | 6/2007 | Galbo et al. | |
| 7,236,193 | B2 | 6/2007 | Suemoto et al. | |
| 7,252,240 | B1 | 8/2007 | Jones et al. | |
| 7,278,051 | B2 | 10/2007 | Mambakkam et al. | |
| 7,295,443 | B2 | 11/2007 | Mambakkam et al. | |
| 7,320,071 | B1 | 1/2008 | Friedman et al. | |
| 7,365,782 | B2 | 4/2008 | Tanaka et al. | |
| 7,367,503 | B2 | 5/2008 | Harai et al. | |
| 7,412,552 | B2 | 8/2008 | Jones et al. | |
| 7,493,437 | B1 | 2/2009 | Jones et al. | |
| 7,522,424 | B2 | 4/2009 | Mambakkan et al. | |
| 7,547,234 | B2 | 6/2009 | Wallace | |
| 7,594,064 | B2 | 9/2009 | Aasheim et al. | |
| 7,690,031 | B2 | 3/2010 | Ma et al. | |
| 7,809,866 | B2 | 10/2010 | Liu et al. | |
| 7,885,123 | B2 | 2/2011 | Rolandi | |
| 2001/0004268 | A1 | 6/2001 | Kubo et al. | |
| 2001/0006400 | A1 | 7/2001 | Kubo et al. | |
| 2001/0009505 | A1 | 7/2001 | Nishizawa et al. | |
| 2001/0014934 | A1 | 8/2001 | Toba | |
| 2001/0016887 | A1 | 8/2001 | Toombs et al. | |
| 2001/0019077 | A1 | 9/2001 | Buschmann | |
| 2001/0039603 | A1 | 11/2001 | Manowitz | |
| 2002/0032813 | A1 | 3/2002 | Hosaka et al. | |
| 2002/0040412 | A1 | 4/2002 | Estakhri et al. | |
| 2002/0065001 | A1 | 5/2002 | Sun | |
| 2002/0065106 | A1 | 5/2002 | Bishop et al. | |
| 2002/0069363 | A1 | 6/2002 | Winbum | |
| 2002/0078297 | A1 | 6/2002 | Toyama et al. | |
| 2002/0078458 | A1 | 6/2002 | Furon et al. | |
| 2002/0080142 | A1 | 6/2002 | Takase et al. | |
| 2002/0111771 | A1 | 8/2002 | Huang et al. | |
| 2002/0113119 | A1 | 8/2002 | Bessel et al. | |
| 2002/0166009 | A1 | 11/2002 | Lin | |
| 2002/0178307 | A1 | 11/2002 | Pua et al. | |
| 2002/0185533 | A1 | 12/2002 | Shieh et al. | |
| 2003/0038177 | A1 | 2/2003 | Morrow | |
| 2003/0041203 | A1 | 2/2003 | Jones et al. | |
| 2003/0041284 | A1 | 2/2003 | Mambakkam et al. | |
| 2003/0046469 | A1 | 3/2003 | Liu et al. | |
| 2003/0056050 | A1 | 3/2003 | Moro | |
| 2003/0060085 | A1 | 3/2003 | Reece | |
| 2003/0070112 | A1 | 4/2003 | York | |
| 2003/0074529 | A1 | 4/2003 | Crohas et al. | |
| 2003/0082961 | A1 | 5/2003 | Mowery et al. | |
| 2003/0084220 | A1 | 5/2003 | Jones et al. | |
| 2003/0084221 | A1 | 5/2003 | Jones et al. | |
| 2003/0088868 | A1 | 5/2003 | Chang et al. | |
| 2003/0093606 | A1 | 5/2003 | Mambakkam et al. | |
| 2003/0095194 | A1 | 5/2003 | Suzuki et al. | |
| 2003/0095386 | A1 | 5/2003 | Le et al. | |
| 2003/0109179 | A1 | 6/2003 | Kaneshiro et al. | |
| 2003/0112611 | A1 | 6/2003 | Nishizawa et al. | |
| 2003/0116624 | A1 | 6/2003 | Chen | |
| 2003/0129944 | A1 | 7/2003 | Chang et al. | |
| 2003/0133270 | A1 | 7/2003 | Liu et al. | |
| 2003/0156303 | A1 | 8/2003 | Schnee et al. | |
| 2003/0167376 | A1 | 9/2003 | Koh | |
| 2003/0168511 | A1 | 9/2003 | Lin | |
| 2003/0172219 | A1 | 9/2003 | Yao | |
| 2003/0172263 | A1 | 9/2003 | Liu | |
| 2003/0178486 | A1 | 9/2003 | Teng et al. | |
| 2003/0201322 | A1 | 10/2003 | Wu | |
| 2003/0229745 | A1 | 12/2003 | Shih | |
| 2003/0229746 | A1 | 12/2003 | Liu et al. | |
| 2004/0027879 | A1 | 2/2004 | Chang | |
| 2004/0030830 | A1 | 2/2004 | Shimizu | |
| 2004/0042323 | A1 | 3/2004 | Moshayedi | |
| 2004/0044864 | A1 | 3/2004 | Cavallo | |
| 2004/0059782 | A1 | 3/2004 | Sivertsen | |
| 2004/0060988 | A1 | 4/2004 | Sakamoto et al. | |
| 2004/0061780 | A1 | 4/2004 | Huffman | |
| 2004/0062109 | A1 | 4/2004 | Wallace | |
| 2004/0063464 | A1 | 4/2004 | Akram et al. | |
| 2004/0073736 | A1 | 4/2004 | Oh et al. | |
| 2004/0106326 | A1 | 6/2004 | Hsieh | |
| 2004/0110423 | A1 | 6/2004 | Shishikura et al. | |
| 2004/0215862 | A1 | 10/2004 | Cedar et al. | |
| 2005/0026505 | A1 | 2/2005 | Washino | |
| 2005/0273648 | A1 | 12/2005 | Mambakkam et al. | |
| 2006/0050155 | A1 | 3/2006 | Ing et al. | |
| 2006/0059385 | A1 | 3/2006 | Atri et al. | |
| 2006/0242460 | A1 | 10/2006 | Mambakkam et al. | |
| 2006/0253636 | A1 | 11/2006 | Jones et al. | |
| 2007/0180177 | A1 | 8/2007 | Jones et al. | |
| 2007/0180291 | A1 | 8/2007 | Galbo et al. | |
| 2007/0283069 | A1 | 12/2007 | Jones et al. | |
| 2007/0283428 | A1 | 12/2007 | Ma et al. | |
| 2007/0288677 | A1 | 12/2007 | Mambakkam et al. | |
| 2008/0009196 | A1 | 1/2008 | Mambakkam et al. | |
| 2008/0017718 | A1 | 1/2008 | Jones et al. | |
| 2008/0071978 | A1 | 3/2008 | Chow et al. | |
| 2008/0220654 | A1 | 9/2008 | Guan et al. | |
| 2008/0299809 | A1 | 12/2008 | Mambakkam et al. | |
| 2009/0100207 | A1 | 4/2009 | Jones et al. | |
| 2010/0138606 | A1 | 6/2010 | Tanaka et al. | |

FOREIGN PATENT DOCUMENTS

| | | | |
|---|---|---|---|
| DE | 20109810 | U1 | 8/2001 |
| EP | 0549568 | A2 | 6/1993 |
| EP | 0744708 | A2 | 11/1996 |
| EP | 0775964 | A2 | 5/1997 |
| EP | 833083 | A1 | 12/1998 |
| EP | 0987876 | A2 | 3/2000 |
| EP | 1037159 | A2 | 9/2000 |
| EP | 1043884 | A1 | 10/2000 |
| EP | 1139208 | A1 | 10/2001 |
| EP | 1146473 | A1 | 10/2001 |
| EP | 1152426 | A2 | 11/2001 |
| EP | 0775964 | A2 | 11/2003 |
| EP | 0775964 | B1 | 11/2003 |
| EP | 1688864 | A1 | 8/2006 |
| EP | 1146428 | B1 | 1/2008 |
| EP | 2085887 | A1 | 8/2009 |
| FR | 2722589 | A1 | 1/1996 |
| FR | 2696863 | A1 | 4/1997 |
| GB | 2263000 | A | 7/1993 |
| GB | 2298743 | A | 9/1996 |
| JP | 03276382 | A | 12/1991 |
| JP | 5108905 | A | 4/1993 |
| JP | 6195524 | A | 7/1994 |
| JP | 8235028 | A | 9/1996 |
| JP | 10-154211 | A | 6/1998 |
| JP | 10512067 | A | 11/1998 |
| JP | 11-15928 | A | 1/1999 |
| JP | 11015928 | A | 1/1999 |
| JP | 11053485 | A | 2/1999 |
| JP | 11-146328 | A | 5/1999 |
| JP | 11184985 | A | 7/1999 |
| JP | 11321019 | A | 11/1999 |
| JP | 11321020 | A | 11/1999 |
| JP | 2000099206 | A | 4/2000 |
| JP | 2000181733 | A | 6/2000 |
| JP | 2000200652 | A | 7/2000 |
| JP | 2000-214970 | A | 8/2000 |
| JP | 2000235463 | A | 8/2000 |
| JP | 2000-286564 | A | 10/2000 |
| JP | 2001022537 | A | 1/2001 |
| JP | 2001022538 | A | 1/2001 |

| | | | |
|---|---|---|---|
| JP | 2001-67303 | A | 3/2001 |
| JP | 2002-157056 | A | 5/2002 |
| JP | 2003-178269 | A | 6/2003 |
| KR | 0317885 | B1 | 7/2002 |
| TW | 456624 | | 9/2001 |
| TW | 464110 | | 11/2001 |
| TW | 490889 | B | 6/2002 |
| TW | 495110 | | 7/2002 |
| WO | 9834218 | A2 | 8/1998 |
| WO | WO9834218 | A2 | 8/1998 |
| WO | 9859298 | A1 | 12/1998 |
| WO | 9945461 | A2 | 9/1999 |
| WO | 9948284 | A1 | 9/1999 |
| WO | 0023936 | A1 | 4/2000 |
| WO | 0106443 | A1 | 1/2001 |
| WO | 0205102 | A1 | 1/2001 |
| WO | 0180171 | A1 | 10/2001 |
| WO | 0213021 | A2 | 2/2002 |
| WO | 2004027617 | A1 | 4/2004 |

OTHER PUBLICATIONS

Samsung, "Application Note for NAND Flash Memory", 1999.
Atmel, "Atmel Multimedia Card Interface Datasheet, 2001", 2001.
Burge, Legand L., et al., "A Ubiquitous Stable Storage for Mobile Computing Devices", Mar. 2001, pp. 401-404, Publisher: ACM, Proceedings of the 2001 ACM Symposium on Applied Computing.
Galbraith, Rob, "Building the Ultimate Photo Recovery Kit, located at http://www.robgalbraith.com/bins/content_page.asp?cid=7-4419-4501", Jan. 23, 2002, pp. 1-20.
Actiontec, "CameraConnect Pro", Oct. 29, 1998, p. 1.
Actiontec, "CameraConnect Pro Parallel Port Flash Card Reader User's Manual", Oct. 28, 1999, pp. 1-29.
CompactFlash Association, "CF+ and CompactFlash Specification; Rev. 1.4, 6 pages", Jul. 1999.
CQ Publishing of Japan, "Interface (article and English translation)", Dec. 1, 1999, pp. 52-131.
DataRescue sa/nv, Inc., "DataRescue Home Page, located at http://web.archive.org/web/20010722191109/http://datarescue.com", Jul. 22, 2001, p. 1.
DataRescue sa/nv, Inc., "DataRescue PhotoRescue Specifications, located at http://web.archive.org/web/20010827073251/www.datarescue.com/photoresc", Aug. 27, 2001, pp. 1-2.
Twice.com, "Digital Imaging Well Exposed at RetailVision, available online at www.twice.com", Apr. 26, 1999, p. 1.
Ontrack Data International, Inc., "EasyRecovery Professional Edition User Guide", 2000, pp. 1-45.
Harper, "Electronic Packaging and Interconnection Handbook, 2nd Ed.", 1997, p. 3.25.
Samsung, "K9D1208V0A-SSB0 Datasheet", 2001.
Samsung, "K9S1208V0M-SSB0 Datasheet", 2001.
Lexmark International, Inc., "Service Manual for 5000 and 5700 Color Jetprinter & 5770 Photo Jetprinter", Oct. 2000.
Steve's Digicams, "Memorex CardMate PCF-100 Flash Memory Card Reader User Review", Apr. 12, 1999, pp. 1-5.
Microtech International, Inc., "Microtech Digital Photography Solutions", Feb. 26, 2000, pp. 1-2.
Microtech International, Inc., "Microtech PCD-47 SCSI Digital Film Reader", May 24, 2000, pp. 1-2.
Steve's Digicams, "Microtech USB Camera Mate User Review", Sep. 5, 1999, pp. 1-4.
"Microtouch Smart Media to PCMCIA Adapter Product Sheet", Jun. 5, 2000.
Lexar Media Web Pages, "Parallel Port, Universal Readers, FAQ, Jumpshot", Jun. 5, 2000.
Microtech International, Inc., "PCD-47 User's Manual, Version 1.1", May 24, 2000, pp. 1-35.
Antec, Inc., "PhotoChute3 USB", Apr. 26, 1999, pp. 1-18.
DataRescue sa/nv, Inc., "Photo Rescue User's Guide ", 2001, pp. 1-8, vol. rev.1.0.
Microtech International, Inc., "Press Release: Microtech Delivers Industry's First 3 Slot SCSI Digital Film Reader", Jan. 5, 2000, pp. 1-2.
Microtech International, Inc., "Press Release: Microtech USB CameraMate Supports IBM Microdrive", Feb. 18, 1999, pp. 1-3.
Intel Corporation, "PXA250 Datasheet", 2002.
Intel Corporation, "PXA250 MMC Controller Application Note", 2002.
Samsung, "SmartMedia White Paper", 2000.
Texas Instruments, "TMS320VC5509 Fixed-Point Digital Signal Processor Data Manual, 2001-2003".
Texas Instruments, "TMS320VC5509 Multi Media Controller Application Report", 2001.
Winbond, "W86L388D Datasheet", 2001.
DataFab Systems, Inc., "DataFab Systems Inc., Leading in Portable Storage Systems, Is Now Offering Dual-Slot CompactFlash and SmartMedia Card Reader," Sep. 10, 1999.
Taiwan Patent Application No. 201032, Filed Aug. 4, 1992 (English Translation Included).
Taiwan Patent Application No. 452152, Filed Nov. 15, 1999 (English Translation Included).
Taiwan Patent Application No. 453560, Filed Mar. 23, 2000 (English Translation Included).
Taiwan Patent Application No. 476170, Filed Nov. 7, 2000 (English Translation Included).
Taiwan Patent Application No. 532611, Filed Dec. 28, 2001 (English Translation Included).
Taiwan Patent Application No. 553510, Filed Jul. 4, 2002 (English Translation Included).
Taiwan Patent Application No. 555256, Filed Aug. 27, 2002 (English Translation Included).
Taiwan Patent Application No. I222028, Filed Jun. 7, 2002 (English Translation Included).
Youtube.com (http://www.youtube.com/watch?v=5Vr7YXDH4CQ), "1999 Sony DSC-D770 Digital Flash Media Camera Pro", Mar. 27, 2012.
Alcor Micro Corp., "AU9331 USB•Secure Digital Card Reader Technical Reference Manual, Rev. 1.2", 2002.
Atmel Corporation, "Atmel AT8xC51SNDIA Design Guide", 2002.
Business Wire, "Addonics Technologies Announces Internal Seven-in-One Flash MC Reader for Any Computer With a 3.5-unch Drive Bay", Mar. 26, 2002.
Phil Askey, "CARDport Swift Syncro (http://www.dpreview.com/reviews/chaseswiftsyncro)", Digital Photography Review, Aug. 2000.
CNET, "Review of Toshiba MEA-110", CNET Reviews, Aug. 18, 2001.
EDN, "Computers & Peripherals, 43, 23; ProQuest", Nov. 5, 1998, p. 244.
Cypress, "Cypress SL11Ride USB to IDE/ATAPI Solution Data Sheet", Nov. 30, 2001.
Epson America, Inc., "Epson Stylus Photo 825 Ink Jet Printer, Printer Basics Guide", Jul. 2002, pp. 1-114.
Fujitsu, FR30 32-bit Microcontroller MB91101/MB91101A Hardware Manual, Fujitsu Semiconductor Controller Manual, Jan. 27, 2000.
SCM Microsystems Inc., "Dazzle 6-in-1 Reader User's Manual", 2002, pp. 1-59.
Jeff Keller, "DCRP Review: Panasonic ipalm PV-DC3000", Digital Camera Resource Page (http://www.dcresource.com/reviews/panasonic/dc3000-review/), Nov. 9, 2000.
Delkin Devices, "eFilm Reader-5 User's Manual, Rev 1.2 (Delkin Part No. DDREADER-05)", 2000, pp. 1-12.
Delkin Devices, "eFilm Reader-18 User's Manual Rev 1.0 (Delkin Part No. DDREADER-18)", 2002, pp. 1-12.
Digitalway Co., Ltd., "MPIO FL 100 User's Guide", Dec. 2002, pp. 1-48.
Genesys Logic, Inc., "GL813-USB2.0 CompactFlash Card Reader Controller Specification 1.2", Apr. 12, 2002.
Genesys Logic, Inc., "GL816-USB2.0 CompactFlash Card Reader Controller", Sep. 20, 2002.
Haruji Ishihara, "High-Density Flash Memory and Flash Memory Card", Hitachi Review, 1998, vol. 47, No. 4, pp. 148-153.
Hewlett Packard, "HP Jornada 600 Series Handheld PC Quick Start Guide", 1999, pp. 1-2.
Hyundai, "HMS31C2816 FC Controller Specification ver. 1.0", System IC SBU, SP BU, MCU Business Division, IDA Team, 2001.

Anne-Bide Stensgaard, "Imation launches FlashGOI in the Middle East", www.ameinfo.com, Mar. 11, 2002.
Kyocera, "Instruction Manual for Kyocera Finecam S3 (Japanese)", available at least by Jun. 2001, pp. 1-91.
Integrated Circuit Solution Inc., "IC1210-F128LQ—USB2.0 All-In-One Flash Card Reader Controller", 2002.
Intel Corp., "Intel PXA250 and PXA210 Applications Processors: Electrical, Mechanical, and Thermal Specification Datasheet", Feb. 2002, pp. 1-46.
Intel Corp., "Using SDCard and SDIO with the Intel PXA250 Applications Processor MMC Controller Application Note", Feb. 2002, pp. 1-16.
Microtech International, Inc., "Instruction Manual for ZiO card reader (available through Kyocera as SDR-1)", Jun. 2001.
M2 Presswire, "New Sitecom intetnal Multi-Memory Reader/Writer offers easy transfer of flash media data", Aug. 1, 2002.
Digital Photography Review, "Microtech unveil ZiO!, Review of ZiO! Reader", Retrieved from http://www.dpreview.com/news/2000/6/27/microtechzio, Jun. 27, 2000.
Peter Cohen, "Microtech ZiO! Works with Secure Digital Cards", Mac Publishing, LLC., Macworld.com (Retreived from http://www.macworld.com/article/1017398/zio.html), May 7, 2001.
Digital Photography Review, "Review of Dazzle Six in One USB card reader", (Retrieved from http://www.dpreview.com/news/2001/10/24/dazzle6in1), Oct. 24, 2001.
Cade Metz, "Review of LaCie Hexa Media Drive", PCMAG.COM (http://www.pcmag.com/article2/0,2817,3898,00.asp), Jun. 30, 2002.
Samsung Memory Product & Technology Division, "NAND/SmartMedia Technical Solution", Sep. 21, 2000.
Neodio Technologies Corporation, "ND3060—Multi-Format Card Reader/Writer Controller with USB Interface Specification", Apr. 4, 2001.
Olympus Optical Co.,Ltd., "Olympus Announces the Innovative 2.5 Megapixel C-2500L SLR Filmless Digital Camera", Aug. 24, 1999.
Olympus Optical Co.,Ltd., "Olympus C-2500L Filmless Digital Camera Datasheet", 1999.
Olympus Optical Co.,Ltd., "Olympus Camedia FlashPath Floppydisk Adapter MAFP-IE User's Manual", Dec. 2000.
Olympus Optical Co.,Ltd., "Olympus Document No. 2679: C-2500L FAQ's", May 26, 2000.
Olympus Optical Co.,Ltd., "Press Releases: Olympus Announces 32MB SmartMedia Card", Jun. 4, 1999.
Ngee, MokHeng, "Put it in the Bin", Computer Times, COMPTI, Aug. 28, 2002.
CSM GmbH, "OmniDrive Specification Sheet", Dec. 11, 2001, pp. 1-2.
M. Wiley, "Panasonic ipalm PV-DC3000 Review", (http://www.ign.com/articles/2001/10/12/panasonic-ipalm-pv-dc3000-review), IGN Entertainment, Inc., Oct. 12, 2001.
Panasonic, "PV-DC3000 Operating Instructions", Sep. 25, 2000, pp. 1-63.
Impress R&D, "Product Overview of MEA110 Mobile Audio Player (Japanese)", Apr. 22, 2000.
MMCA Technical Committee, "The MultiMediaCard System Summary, Based onSystem Specification Version 2.2", Jan. 2000, pp. 1-27.
MMCA Technical Committee, "MultiMediaCard System Specification Version 2.11 Official Release", Jun. 1999 pp. 1-123.
SCM Microsystems, "PC Card Reader/Writer PCD-47/PCD-47BH", May 1, 1999, pp. 1-35.
Jason Cox , "Review of Microtech ZiO USB CompactFlash Card Reader", PCWorld (Retrieved from http://www.pcworld.com/product/407107/microtech_zio_usb_compactflash_card_reader_rating.html?p=review), Feb. 1, 2001.
Byrds Research & Publishing, Ltd, "Review of MindStor PSS-1705", iXBT Labs (http://ixbtlabs.com/articles/mindstor/index.html), Apr. 26, 2002.
Ian Burley, "Review of OmniFlash Uno Mas Universal Card Reader", Digital Photography Now, (Retrieved from http://dpnow.com/vintage/Features/Peripheral_reviews/perif2/perif2.html), Mar. 6, 2002.
Epinions.com, "Review of SmartDisk Dazzle 6-in-1 Reader (DM-8400)—The Dazzle DM-8400 Univeral Flash Card Reader—A Jack of All Trade", (http://www.epinions.com/review/cmhd-Components-All-SIX_IN_ONE_READER_W_DVD_S_W_DM8400/content_67507687044?sb=1), Jun. 20, 2002.
Samsung Electronics Memory Product & Technology Division, "Flash / SmartMedia File System Presentation", Feb. 2, 2000.
Samsung Electronics Memory Product & Technology Division, "Samsung presentation, SmartMedia Format Introduction (Software considerations)", Jul. 17, 1999.
Samsung Electronics, "Samsung's ATA Flash Controllers Reference Design Manual", Jan. 23, 2001.
Samsung Memory Product & Technology Division, "SmartMedia Application", Mar. 15, 2000.
SanDisk Corporation, "SanDisk MultiMedia Card Product Manual Rev 2", 2000, pp. 1-86.
SanDisk Corporation, "SmartMedia 32 Mbyte Product Manual Rev 1.1", 2001, pp. 1-54.
Takada, Tomoji et al., "SD Card and SD Host Controller LSIs", Toshiba Review, Jan. 2002, vol. 57 No. 1 pp. 54-57.
SD Association, "SD Card Specification, Simplified Version of: Part E1, Secure Digital Input/Output (SDIO) Card Specification", Oct. 2001.
SD Group, "Supplementary Notes for: SD Memory Card Specifications, Part 1, Physical Layer Specification, Version 1.0", Jun. 2000.
SD Association, "SD Memory Card File System Test Specification for SD Host Products, Version 1.0", Aug. 2001.
SD Group, "SD Memory Card Simplified Specifications, Part 1 Physical Layer Specification, Version 0.96", Jan. 2000, pp. 1-28.
SD Group, "SD Memory Card Specifications, Part 1, Physical Layer Specification, Version 1.0", Mar. 2000.
STMicroelectronics, "ST92163 Preliminary Data", Jan. 2000.
Steve's Digicam Online, Inc., "Review of Pixo Media 4-in-1 Multi PC-Card Adapter", Nov. 20, 2001.
Steve's Digicams Online, Inc., "Review of AcomData Multiflash USB Flash Card Reader/Writer", Jul. 18, 2001.
Steve's Digicams Online, Inc., "Review of BUSlink 6 in 1 Data Banker", Jan. 25, 2002.
Steve's Digicams Online, Inc., "Review of Dazzle 6 in 1 Reader", Jan. 28, 2002.
Steve's Digicam Online, Inc., "Review of Kyocera Finecam S-3", May 7, 2001.
Steve's Digicam Online, Inc., "Review of LexarMedia USB Universal Card Reader", Jan. 22, 2001.
Steve's Digicam Online, Inc., "Review of Panasonic iPalm PV-DC3000", Nov. 10, 2000.
Steve's Digicam Online, Inc. , "Review of Atech Flash Technology PRO II Flash Card Reader", (http://www.steves-digicams.com/2002_reviews/aft_pro2.html), May 9, 2002.
eMedia Asia Ltd., "TaiSol connector supports various media cards", EE Times Asia (http://www.eetasia.com/ART_8800226933_499491_NP_eb07bea3.HTM), Apr. 23, 2002.
TaiSol Electronics, "International patent awarded for 4-in-1 flash memory connector", Jul. 1, 2002.
Nan Barber, "The Aisle Less Traveled: A Macworld Expo Floor Report", MacDevCenter (http://www.macdevcenter.com/), O'Reilly Media, Inc., Jul. 18, 2002.
Toshiba Corporation, "Toshiba Companion Chip for TMPR3922U TC6358TB(PLUM2) Technical Data", Oct. 19, 1998.
Toshiba Corporation, "Toshiba Companion Chip for TX3922 PLUM2", Mar. 5, 1999.
Toshiba Corporation, "Owner's Manual of MEA110 Mobile Audio Player", available at least by Apr. 22, 2000, pp. 1-45.
Toshiba Corporation, "Toshiba SD Card Specification ver 2.11", May 31, 2002.
Toshiba Corporation, "SD Memory Card/SmartMedia Inteface Controller TC6377BF/TC6384AF Specification", Jun. 25, 2001.
Toshiba Corporation, "TC6374AF (3in1 ATA) PC Card ATA to SD Memory Card, Multimedia Card and SmartMedia Controller", Feb. 15, 2002.
Toshiba Corporation, "SD Memory Card / SDIO Card / SmartMedia Controller TC6380AF Outline", Apr. 10, 2002.

Wright, Mary, "To the Victor Will Go the Spoils in the Tiny-Flash-Card Battle", EDN Access, Jan. 16, 1997.
STMicroelectronics, "USB Flash Card Writer Using ST92163", Nov. 2000.
Viking Components, Inc., "Viking Intelliflash USB Flash Memory Reader User's Guide, Rev. B", May 2000.
Digital Photography Review, "Viking Announce IntelliFlash USB Flash Memory Reader", (Retrieved from http://www.dpreview.com/news/2000/3/21/viking), Mar. 21, 2000.
Tokyo Electron Device Limited, "TEL TE4300 data sheet", 2003, pp. 1-29.
Kim, Jesung, et al., "A Space-Efficient Flash Translation Layer for Compactflash Systems", IEEE Transactions on Consumer Electronics, May 2002, vol. 48 No. 2 pp. 366-376.
Toshiba Corporation, Product Overview of MEA110 Mobile Audio Player, available at least by Apr. 22, 2000, pp. 287-298.
Texas Instruments, "Programming the TMS320VC5509 Multi Media Controller in Native Model—Application Report", Dec. 2001, pp. 1-13.
Motorola, Inc. "MPC8260 Power QUICC II—User's Manual", Apr. 1999, pp. 1-490.
Motorola, Inc. "MPC8260 Power QUICC II—User's Manual", Apr. 1999, pp. 491-1006.
SCM Microsystems, "SCSI Interface: PCD-47 series" (archived from www.scmmicro.com), May 1, 1999, pp. 1-2.
Atmel, "Multimedia Card Interface Datasheet", 2001.
Intel, "PXA250 Datasheet", 2002.
Hiroshi, Takeyama et al., "The favorite of next generation IC card, fundamental and application of multimedia card usage [First]", Inteface Magazine, May 1, 2000, vol. 26, No. 5, pp. 166-174.
Hiroshi, Takeyama et al., "The favorite of next generation IC card, fundamental and application of multimedia card usage [Second]", Inteface Magazine, Jun. 1, 2000, vol. 26, No. 5, pp. 178-188.
Alcor Micro Corp., "AU9360 USB Multiple Slots Flash Memory Card Reader Controller TRM, Datasheet Revision 1.2", Mar. 26, 2003.
Atmel Corporation, "Atmel 32-bit Embedded ASIC Core Peripheral: Multimedia Card Interface (MCI) Datasheet", Dec. 2001.
SCM Microsystems, "PC Card Reader/Writer PCD-47/PCD-47BH User's Manual, ver. 1.0", May 1, 1999, pp. 1-35.
Steve's Digicams, Review of Atech Flash Technology PRO II Flash Card Reader, May 9, 2002.
Investigation No. 337-TA-841, "Complainant Technology Properties Limited LLC's Responsive Claim Construction Brief", Jul. 23, 2012.
Investigation No. 337-TA-841, "Complainant Technology Properties Limited LLC's Opening Claim Construction Brief", Aug. 3, 2012.
Inv. No. 337-TA-841, Order Construing the Terms of the Asserted Claims of the Patents at ISSE, dated Oct. 4, 2012.
Inv. No. 337-TA-841, Respondents' Notice of Prior Art, dated Aug. 31, 2012.
US 7,264,513, 09/2007, Moshayedi (withdrawn)

* cited by examiner

CONNECTOR PINS

| PIN | SMART MEDIA | MMC/ SD | MEMORY STICK |
|---|---|---|---|
| 1 | D0/-WPSW | | |
| 2 | D1 | -WP | |
| 3 | D2 | -CD | |
| 4 | D3 | MCMD | |
| 5 | D4 | | -CD |
| 6 | D5 | | BS |
| 7 | D6 | | SDIO |
| 8 | D7 | | |
| 9 | LVD | | |
| 10 | -WE | D0 | |
| 11 | -RE | D1 | |
| 12 | -ALE | D2 | |
| 13 | -CLE | D3 | |
| 14 | READY | | |
| 15 | -CE | | |
| 16 | -WP | | |
| 17 | -WPSW | | |
| 18 | GROUND | GROUND | GROUND |
| 19 | POWER | | |
| 20 | | POWER | POWER |
| 21 | | CLK | MCLK |

| PIN | XD | MMC/ SD (REGULAR SIZE) | MEMORY STICK (REGULAR SIZE) | SMART MEDIA | MINISD | RS MMC | MEMORY STICK DUO |
|---|---|---|---|---|---|---|---|
| 1 | GROUND | GROUND | GROUND | GROUND | GROUND | GROUND | GROUND |
| 2 | -CD1 | | | | | | |
| 3 | RDY | MCMD | BS | RDY | MCMD | MCMD | BS |
| 4 | -RE | SD0 | SDIO (MSD0) | -RE | SDD0 | SDD0 | SDIO (MSD0) |
| 5 | -CS | SD1 | MSD1 | -CS | SDD1 | SDD1 | MSD1 |
| 6 | CLE | SD2 | MSD2 | CLE | SDD2 | SDD2 | MSD2 |
| 7 | ALE | SD3 | MSD3 | ALE | SDD3 | SDD3 | MSD3 |
| 8 | -WE | CLK | CLK | -WE | CLK | CLK | CLK |
| 9 | WP | -WP | | WP | | | |
| 10 | D0 | -CD2 | | D0 | | | |
| 11 | D1 | | -CD3 | D1 | | | |
| 12 | D2 | | | D2/-CD4 | | | |
| 13 | D3 | | | D3 | -CD5 | | |
| 14 | D4 | | | D4 | | -CD6 | |
| 15 | D5 | | | D5 | | | -CD7 |
| 16 | D6 | | | D6/-WPSW | | | |
| 17 | D7 | | | D7/LVD | | | |
| 18 | POWER | POWER | POWER | POWER | POWER | POWER | POWER |

*FIG. 5*

SMARTCONNECT FLASH CARD ADAPTER

Under 35 U.S.C. §120, this application is a continuation of U.S. application Ser. No. 12/759,550, filed Apr. 13, 2010, now U.S. Pat. No. 8,011,964, which is a continuation of U.S. application Ser. No. 12/189,725, filed Aug. 11, 2008, now U.S. Pat. No. 7,719,847, which is a continuation of U.S. patent application Ser. No. 11/858,086, filed Sep. 19, 2007, now U.S. Pat. No. 7,522,424, which is a continuation of U.S. application Ser. No. 11/492,556, filed Jul. 24, 2006, now U.S. Pat. No. 7,295,443, which is a continuation of U.S. application Ser. No. 10/887,635 filed Jul. 8, 2004, now U.S. Pat. No. 7,095,618, which is a continuation-in-part application of U.S. application Ser. No. 10/064,966, which was filed on Sep. 4, 2002, now U.S. Pat. No. 6,859,369, which is a continued-in-part continuation-in-part application of U.S. application Ser. No. 10/167,925, which was filed on Jun. 11, 2002, now U.S. Pat. No. 7,222,205, which is a continuation application of U.S. application Ser. No. 09/610,904 which was filed Jul. 6, 2000, now U.S. Pat. No. 6,438,638, and is titled "Flashtoaster for reading several types of flash memory cards with or without a PC." U.S. application Ser. No. 10/064,966 is also a continuation-in-part of U.S. application Ser. No. 10/039,685 which was filed Oct. 29, 2001, now U.S. Pat. No. 6,832,281 and is titled, "Flashtoaster for reading several types of flash memory cards with or without a PC" and a continuation-in-part of U.S. application Ser. No. 10/002,567 which was filed Nov. 1, 2001 and is titled, "Active Adapter Chip for Use in a Flash Card Reader." The priority of the above-referenced applications is hereby claimed, and the entireties of the above-referenced applications are incorporated herein by this reference, and all of the above-referenced applications are assigned to the assignee of the present invention.

FIELD

The present invention relates generally to flash media adapters, and more specifically to an improved configuration of the same.

BACKGROUND

In U.S. patent application Ser. No. 10/002,567, entitled "Active Adapter Chip for Use in a Flash Card Reader", filed Nov. 1, 2001, and assigned to the assignee of the present application, a universal active adapter chip is disclosed that can be used to construct a flash media system or various active flash media adapters using the CompactFlash card or PCMCIA (PC Card) form factor. A standard reader that reads CompactFlash cards or PC cards can then read any of the other flash-memory cards that plug into the CompactFlash or PC Card adapter. The adapters come with a conversion chip that makes each of the flash media work just like a CompactFlash or PC Card media, as applicable.

FIG. 1 shows a multi-standard card reader system 142. In the field of multi-standard adapters, multi-memory media adapter 140 may be an active adapter or, alternatively, may be a passive adapter. Reader 142 can adapt on the host side to either CompactFlash card 149, PCMCIA card 153, or IDE card 151. On the media side, the reader can adapt to a MultiMediaCard 141, or a Secure Digital card 143, which have the same form factor but slightly different pin-out; a SmartMedia card 145, which has a different pin-out; or a Memory Stick 147. In general, the reader 142 can adapt to any generic flash media 146 that has a similar or smaller form factor.

It is possible to place the connector such that all the media sit in one opening. FIG. 2 is a cutaway side view of a PCMCIA adapter card 200 of the type that is available as a standard commercial product today. FIG. 2 illustrates several drawbacks in the typical configuration of a PCMCIA adapter. Adapter 200 includes two PCBs, namely PCB 210 and PCB 220. The two PCBs are separated by a mounting frame (typically plastic), not shown. The mounting frame acts as a spacer between PCB 210 and PCB 220, which holds the two PCBs together at a specified distance and functions in other capacities as described below. The space between the two PCBs creates the opening (port) 211 into which the flash media cards are inserted. PCB 230 is straddle-mounted between PCB 210 and PCB 220. PCB 230 contains the active components including controller chip 231 that perform handshaking and data transfer. PCB 230 is connected to a PCMCIA connector 240. PCB 230 is mounted between PCB 210 and PCB 220 with interconnects 212. PCB 210 has two sets of floating contact pins, contact pin set 214 includes nine contact pins and contact pin set 215 includes ten contact pins, which provide interfaces for MMC/SD and MemoryStick flash media respectively. PCB 220 has two sets of floating contact pins 224 and 225, each including 11 pins, which together provide the interface for SmartMedia flash media.

The mounting frame that holds PCB 210 and 220 together is configured such that each type of flash media is inserted in a particular location within the connector. In FIG. 2, opening 211 is a simplified view. Typically, the opening is stepped with different widths and heights in different locations that index the flash media cards into specific locations upon insertion. This allows each flash medium to be properly aligned with the corresponding contact pin set(s). Additionally, stops are typically provided to stop the insertion at the correct depth, again, to guarantee connection to the right contact pin set.

This typical approach has several serious drawbacks.

Manufacturing

The straddle-mount configured flash media adapter is very expensive to manufacture for several reasons. Often such devices require manual labor for manufacturing and testing, or the use of very expensive soldering robots, instead of standard production techniques. A further problem is the additive effect of manufacturing tolerances, such as primary connector (i.e., PCMCIA) to PCB, to straddle mount connector to secondary PCB to contacts on PCB, resulting in as many as two, three, or in some cases even four tolerances adding up, which makes requirements for tolerances either absurdly expensive, or causes a big yield problem in manufacturing. Additionally, PCB 230 must be thin enough so that it can be mounted between PCB 210 and PCB 220 in the space allocated for the insertion of the various flash media. That is, PCB 230, together with the interconnects 212 that mount it between PCB 210 and PCB 220 must be no larger than opening 211. The manufacture of thin PCBs to accommodate this design point adds to the expense and complexity of manufacturing the flash media adapter.

Contact Pins

The floating contact pins are subject to damage and deterioration. The various flash media cards have different thickness, and even the same flash media may have different thickness if produced by different manufacturers. The flash media cards exert pressure upon the floating contact pins, which eventually causes their resiliency to be reduced. When subsequently, a thinner flash media card is inserted into the flash media adapter, the corresponding contact pins may not make connection with the flash media card. Additionally if a flash media card is inserted incorrectly (e.g., upside down), removal of the flash media card may damage the contact pins.

Interface

Some devices don't have the 68-pin PCMCIA interface. For example, some recent notebook computer models only have the electrically equivalent 50-pin CF interface. Typical adapter cards such as PCMCIA adapter card 200 are incompatible with a 50-pin CF interface.

SUMMARY

An embodiment of the present invention provides a multi-memory media adaptor comprised of a first planar element having an upper surface and a lower surface and a second planar element having an upper surface and a lower surface. The two planar elements are formed from a single piece of molded plastic and disposed so as to form a port capable of receiving a memory media card. The adapter has at least one set of contact pins protruding from the lower surface of the first planar element or the upper surface of the second planar element such that the at least one set of contact pins are disposed within the port. The at least one set of contact pins are capable of contacting the contacts of a memory media card inserted into the port.

Other features and advantages of embodiments of the present invention will be apparent from the accompanying drawings, and from the detailed description, that follows below.

BRIEF DESCRIPTION OF THE DRAWINGS

The invention may be best understood by referring to the following description and accompanying drawings that are used to illustrate embodiments of the invention. In the drawings:

FIG. 5 is a table of pin mappings for the xD, standard MMC/SD, standard Memory Stick, SmartMedia, miniSD, RSMMC, and MS Duo to an 18-pin connector in accordance with one embodiment of the present invention;

DETAILED DESCRIPTION

Figure 1:
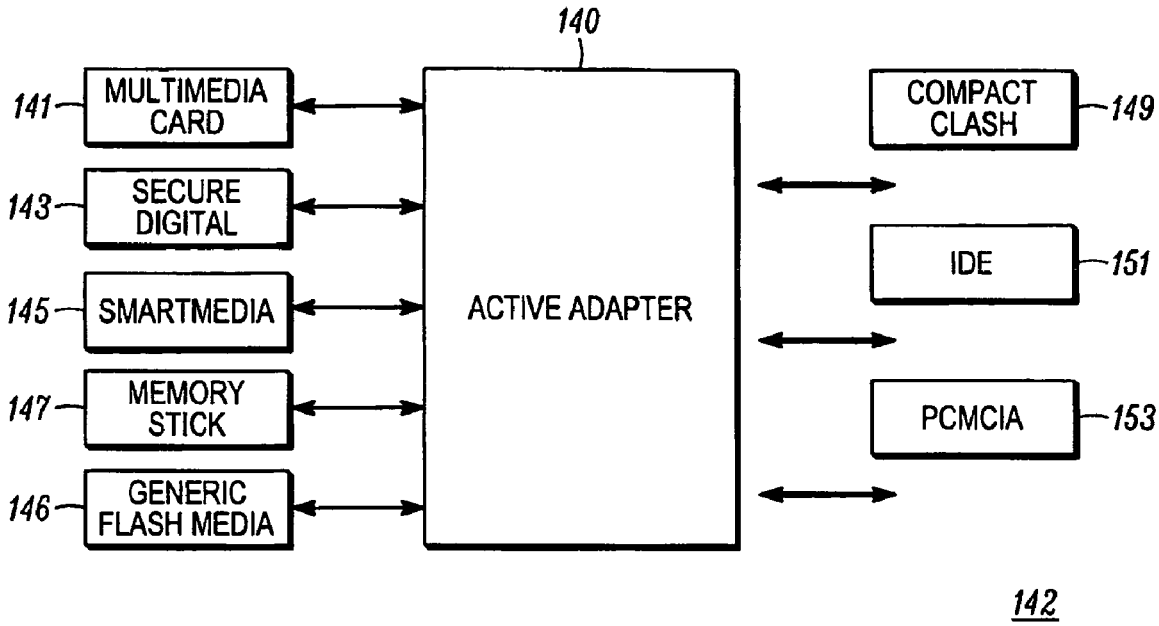
(PRIOR ART) FIG. 1
FIG. 1 illustrates a multi-standard card reader system.
Figure 2:
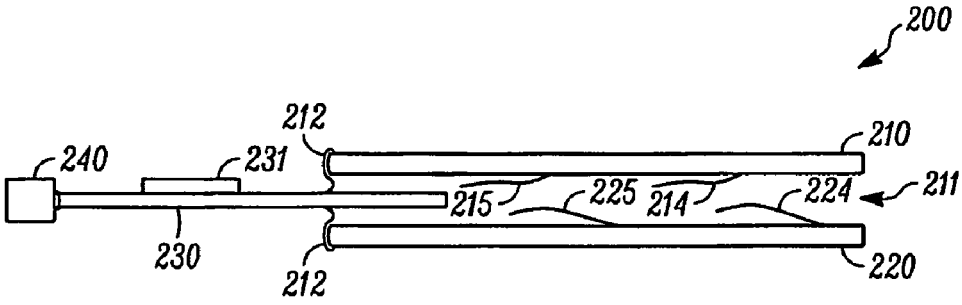
(PRIOR ART) FIG. 2
FIG. 2 is a cutaway side view of a PCMCIA adapter card of the type that is available as a standard commercial product today.

An embodiment of the present invention provides a multi-memory media adapter card configured to reduce or eliminate some of the drawbacks of typical adapter card configuration. In accordance with various embodiments of the present invention, the top and bottom PCBs of prior art configurations are replaced by molded plastic elements that provide greater structural integrity. The straddle-mounted controller board is replaced with a PCB adjacent to the bottom element and having a surface mounted standard connector that may be a PCMCIA or a CompactFlash connector. The contact pins are formed so as to better maintain their resiliency and avoid damage upon removal of the memory media card. In one embodiment, a light pipe is locked in place between the top and bottom elements of the adapter card so as to conduct light from a signal lamp on the PCB through the port.

It is an intended advantage of one embodiment of the present invention to reduce the manufacturing cost and complexity of an adapter card. It is another intended advantage of one embodiment of the present invention to provide an adapter card with greater structural integrity. It is another intended advantage of one embodiment of the present invention to provide an adapter card with contact pins that retain their resiliency to a greater degree than floating contact pins. It is another intended advantage of one embodiment of the present invention to provide an adapter card with contact pins that are less likely to be damaged upon removal of a memory media card. It is another intended advantage of one embodiment of the present invention to provide an adapter card with a surface mounted standard connector including PCMCIA and CompactFlash connectors.

In the following description, numerous specific details are set forth. However, it is understood that embodiments of the invention may be practiced without these specific details. In other instances, well-known circuits, structures and techniques have not been shown in detail in order not to obscure the understanding of this description.

Reference throughout the specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout the specification are not necessarily all referring to the same embodiment. Furthermore, the particular features, structures, or characteristics may be combined in any suitable manner in one or more embodiments.

Similarly, it should be appreciated that in the foregoing description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Figures 3, 4:
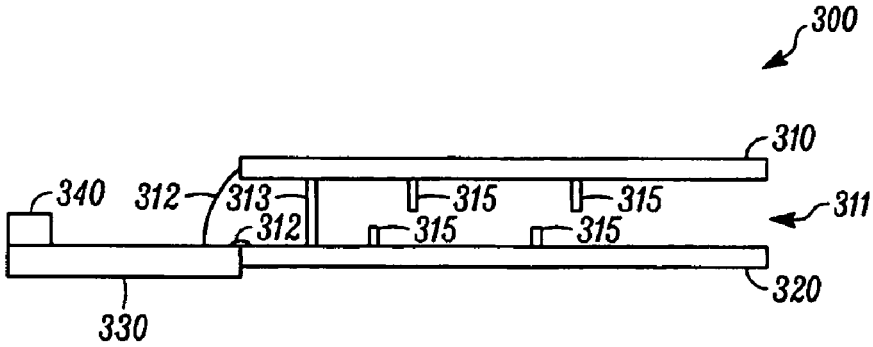
FIG. 3 is a cutaway side view of an integrated standard connector adapter card according to one embodiment of the present invention.
FIG. 4 is a table of pin mappings for the SmartMedia, MMC/SD, and Memory Stick to a 21-pin connector in accordance with one embodiment of the present invention.

FIG. 3 is a cutaway side view of an integrated standard connector adapter card according to one embodiment of the present invention. Adapter card 300, shown in FIG. 3, includes a top planar element 310 and a bottom planar element 320, both of which may be PCBs. Alternatively, the top planar element 310 and the bottom planar element 320 may be formed from molded plastic. A spacer, not shown, holds the two planar elements apart, forming port 311 into which memory media cards are inserted. In order to meet the low height requirements (thickness of PCMCIA or CF cards), the ports are registered on one opening, and contacts are distributed on both sides. Additionally, the port 311 may be formed with card stops to prevent improper insertion of memory media cards.

For one embodiment, both planar elements and the spacer between them are created from molded plastic. For such an embodiment, the molded plastic provides greater resistance to pressure applied to the outer surfaces of adapter card 300. This helps to prevent planar element 310 and planar element 320 from contacting each other and possibly damaging internal components.

Adapter 300 also includes a number of sets of contact pins, shown collectively as contact pin set 315, protruding from the lower surface of planar element 310 and from the upper surface of planar element 320. The contact pins electrically couple to corresponding contacts on a memory media card inserted into port 311. For an embodiment in which the planar elements 310 and 320 are formed from molded plastic, contact pin sets 315 may be formed from injected contacts with protruding pins. This provides a more robust contact pin than the floating contact pins of the prior art, thereby lessening the likelihood that the resiliency of the contact pin will be reduced to the point that the pin no longer contacts the inserted memory media card. Alternatively, or additionally, the contact pins may be angled or shaped such that damage due to the abrupt removal of an improperly (or properly) inserted card is reduced or eliminated. For example the terminal end of the contact pin may be angled or curved toward the planar surface from which the contact pin protrudes, or may be spherically shaped.

Adapter 300 includes planar element 330 that has standard connector 340 mounted thereon. Planar element 330 is adjacent to bottom planar element 320. Standard connector 340, which may be for example, a compact flash, PCMCIA, USB, or serial ATA connector is surface-mounted to planar element 330. Interconnects 312 that electrically connect the standard connector 340 to contact pins 315 are also located on planar element 330. The adapter connects the proper pin from the contact pins to planar element 330. Simple wiring such as individual wires, flat cables, printed-circuit board (PCB), or wiring traces can be used. In accordance with an embodiment of the present invention, the need for a straddle-mounted PCB, and its associated manufacturing costs and complexity, is eliminated. Moreover, by eliminating the layers of a straddle-mount configuration, registration accuracy is improved. For one embodiment, a single PCB may comprise bottom planar element 320 and planar element 330.

For one embodiment, a multi-memory media adapter having only 21 pins is used to accommodate various commercially available flash memory media. FIG. 4 is a table of pin mappings for the SmartMedia, MMC/SD, and Memory Stick to a 21-pin connector in accordance with one embodiment of the present invention.

Pin 18 is a ground pin for each connector. Pin 19 is a power pin for SmartMedia, while pin 20 is a power pin for MMC/SD, and Memory Stick.

The SmartMedia interface has a parallel data bus of 8 bits. These are mapped to pins 1 8. While no separate address bus is provided, address and data are multiplexed. Control signals for latch enables, write enable and protect, output enable, and ready handshake are among the control signals.

For the Memory Stick and MMC/SD flash-memory-card interfaces, parallel data or address busses are not present. Instead, serial data transfers occur through serial data pin DIO, which is mapped to pin 7 for the Memory Stick, and pin 10 (D0) for the MMC/SD flash-memory-card interfaces. Data is clocked in synchronization to clock MCLK and CLK, for Memory Stick and MMC/SD, respectively, on pin 21. A BS, for Memory Stick, occupies pin 6, and a command signal CMD, for MMC/SD, occupies pin 4. The Memory Stick interfaces require only 4 pins plus power and ground, while MMC/SD requires 8 pins plus power and ground.

Thus, it is possible to accommodate SmartMedia, MMC/SD, and Memory Stick with a 21-pin connector (i.e., instead of 41 pins) by multiplexing the available pins. For one embodiment, the controller chip (e.g., controller chip 231) differentiates the pin configuration for each flash memory media type. The controller may include a shifter connected to the data and clock signals from the MMC/SD and Memory Stick flash-memory cards. The shifter may clock one bit (serial) or word (parallel) of data each clock pulse. A cyclical redundancy check (CRC) can be performed on the data to detect errors.

For an alternative embodiment, a multi-memory media adapter, having only 18 pins, is used to accommodate various commercially available flash memory media including media that have recently become commercially available. Such recent additions include a miniSD card (i.e., an MMC/SD card with a smaller form factor), an MS Duo (i.e., a Memory Stick card with a smaller form factor), a Reduced Size MultiMedia Card (RSMMC), and an xD card (a controller-less Flash media, similar in function to SmartMedia).

FIG. 5 is a table of pin mappings for the xD, standard MMC/SD, standard Memory Stick, SmartMedia, miniSD, RSMMC, MMC/SD, and MS Duo to an 18-pin connector in accordance with one embodiment of the present invention.

For such an embodiment, pin 1 is a ground pin and pin 18 is a power pin for each connector. The data lines for the SmartMedia and xD interface cards have a parallel data bus of 8 bits denoted as DO-D7 that occupy pins 10-17. These data bus lines are multiplexed to serve as card-detect lines for the remaining media types.

As described in application Ser. No. 09/610,904 (now U.S. Pat. No. 6,438,638), the signal lines to the controller are normally pulled high. When a card is inserted, the card pulls its connected pins low. Detection of card type is determined by detection of which of the mapped card detect lines is pulled low as illustrated in FIG. 5, or by the (binary) state of data or other card pins mapped to a common set of controller pins as described in the aforesaid parent application. See, e.g., FIGS. 4A-E of 09/610,904, now U.S. Pat. No. 6,438,638. While no separate address bus is provided, address and data are multiplexed.

The data lines of the miniSD and RSMMC and the Memory Stick (and MS Duo) flash-memory-card interfaces are denoted as SDD0-SDD3 and MSD0-MSD3, respectively, and occupy pins 4-7.

Thus, it is possible to accommodate xD, standard MMC/SD, standard Memory Stick, SmartMedia, miniSD, RSMMC, MMC/SD, and MS Duo with an 18-pin connector by multiplexing the available pins. Again, the controller chip may differentiate the pin configuration for each flash memory media type.

Figure 6:
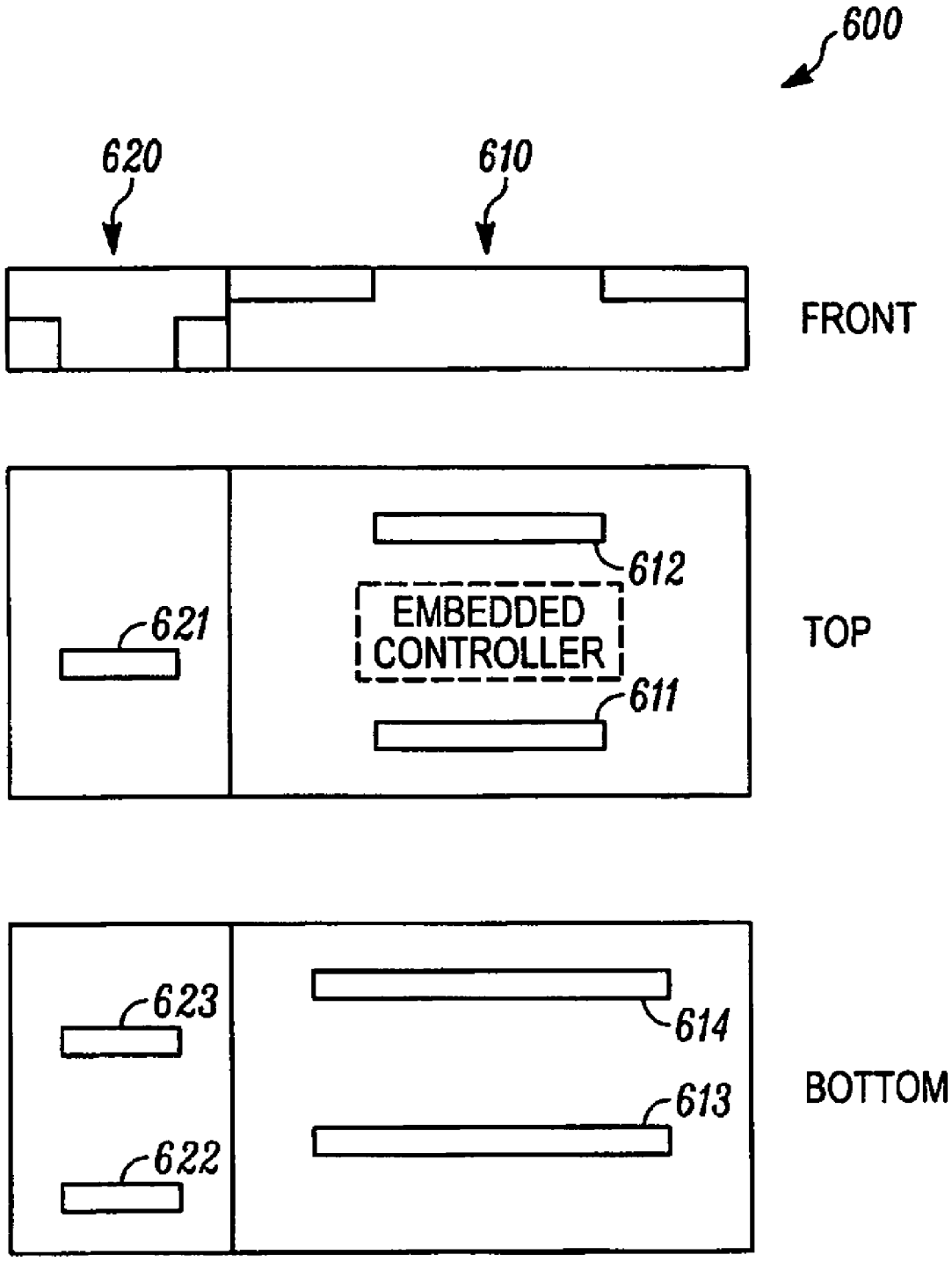
FIG. 6 illustrates an integrated standard connector adapter card, according to one embodiment of the present invention, in front view, top view, and bottom view.

FIG. 6 illustrates an integrated standard connector adapter card according to one embodiment of the present invention in front view, top view, and bottom view. Adapter card 600, shown in FIG. 6, includes two housings, namely housing 610 and housing 620. For one embodiment of the invention, the pins are in a single row. As shown from the top view of adapter card 600, a top-front set of pins 611 in housing 610 can be used to interface to an xD card, a top-rear set of pins 612 in housing 610 can be used to interface to a SmartMedia card. A top-front set of pins 621 in housing 620 can be used to interface an RSMMC card. As shown in the bottom view of adapter card 600, a bottom-front set of pins 613 in housing 610 can be used to interface to an SD/MMC MMC/SD card, a bottom-rear set of pins 614 in housing 610 can be used to interface to a standard size Memory Stick card. A bottom-front set of pins 622 in housing 620 can be used to interface a miniSD card. A bottom-rear set of pins 623 in housing 620 can be used to interface a Memory Stick MS Duo.

Figure 7:
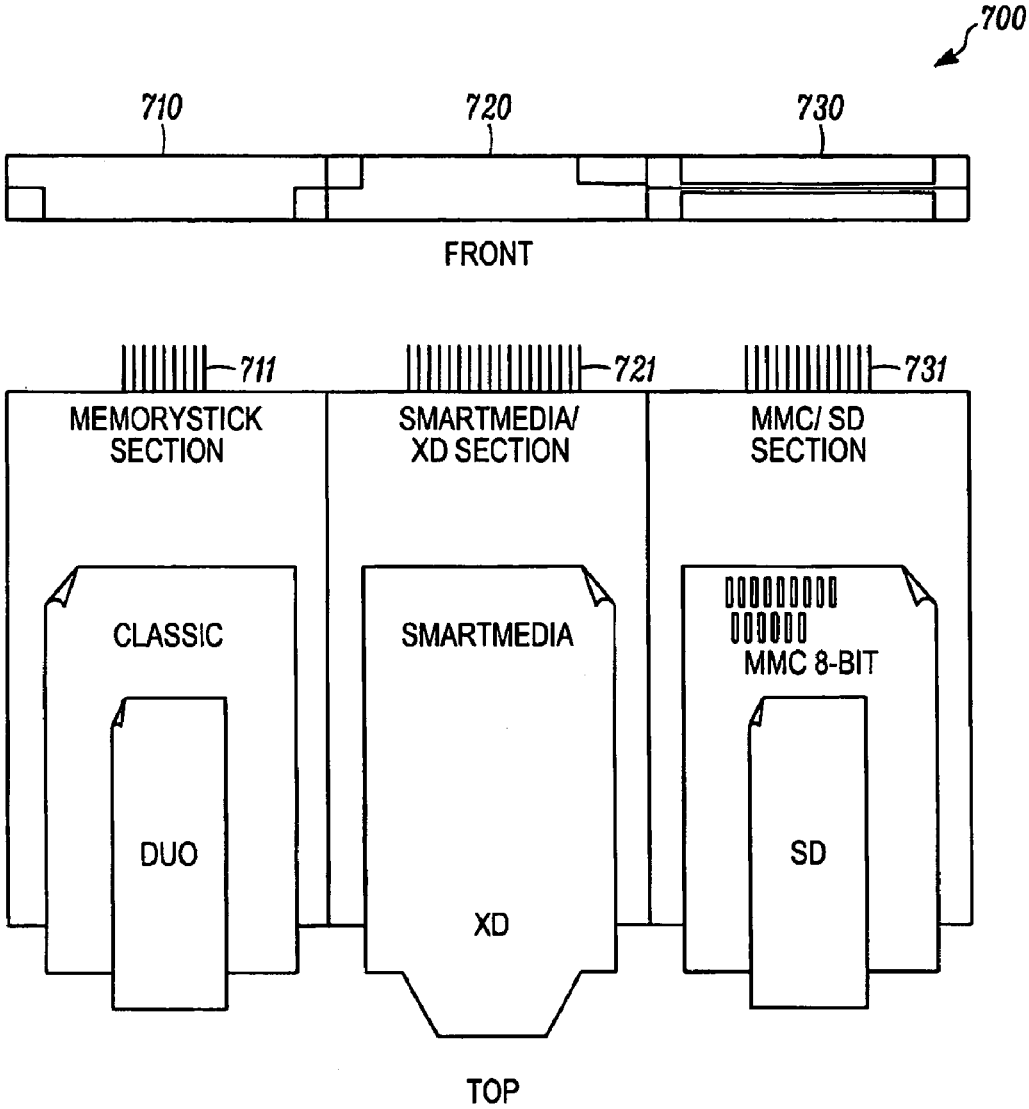
FIG. 7 illustrates an integrated standard connector adapter card, according to one embodiment of the present invention, in front view and top view.

FIG. 7 illustrates an integrated standard connector adapter card, according to one embodiment of the present invention, in front view and top view. Adapter card 700, shown in FIG. 7, includes three housings, namely section 710 (Memory Stick), section 720 (SM/xD), and section 730 (MMC/SD). This arrangement allows pins to be laid out in a planar fashion, thus effecting saving in layout and allowing for assignment of one drive for each section. The spacing is designed so that only one media can be inserted at a time. For one embodiment, the Memory Stick could be on the top portion of section 710 (with MS Duo on the bottom portion), while SmartMedia is on the top portion of section 720 with xD on the bottom portion of section 720. According to one such embodiment, the MMC (including the recently designed 8-bit MMC) could be on the top-rear portion of the MMC/SD section 730, while the SD could be on the bottom-rear portion of the MMC/SD section 730. RSMMC could be on the top-front portion of the MMC/SD section 730 and miniSD could be on the bottom-front portion of the MMC/SD section 730.

Figure 7A:
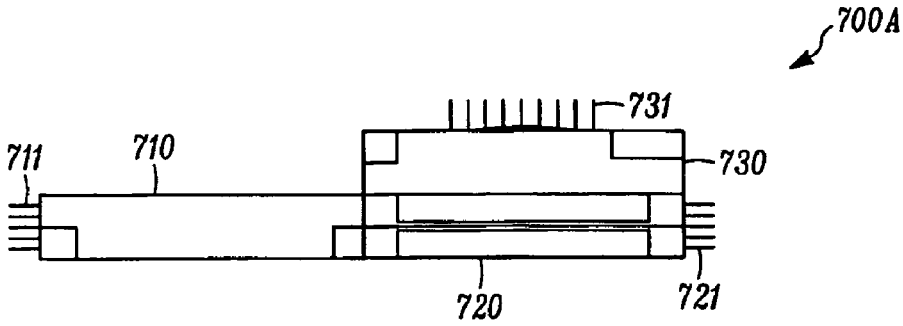
FIG. 7A illustrates an alternative embodiment of an adapter 700A in accordance with one embodiment of the invention.

FIG. 7A illustrates an alternative embodiment of an adapter 700A in accordance with one embodiment of the invention. As shown in FIG. 7A, adapter 700 includes sections 710, 720, and 730 with sections 710 and 730 positioned vertically, but section 720 stacked horizontally upon section 730. In such an embodiment, external pins 711, 721, and 731 may be positioned as shown to avoid intersection or congestion of the external connections.

As described above in reference to FIG. 3, an adapter in accordance with one embodiment of the invention includes a planar element that may have a controller chip attached to a standard connector (e.g., PCMCIA, USB, WiFi, Firewire, IDE, CF, or serial ATA connector) mounted thereon. In accordance with an alternative embodiment of the invention, the controller chip is integrated into the housing of the adapter. For example, the adapter may be formed of a single piece of molded plastic, with the controller chip and an associated memory device (e.g., ROM) embedded into the molded plastic. For such an embodiment, the continuous molded plastic that forms the adapter also forms the device package for the controller die.

General Matters

Embodiments of the present invention provide an improved configuration for a multi-memory media adapter card. For one embodiment, the adapter may comprise an injected plastic part, forming the mechanical port, as well as holding any and all contacts in its structure, thus eliminating the multiple tolerances of conventional configurations (i.e., two PCBs sandwiching a mechanical frame). For one embodiment, two half shells with integrated contacts are snapped together, allowing for a simple, but accurate mounting by means of guides for snapping them together. In particular, the total assembly of the port may be composed of two parts, a top and bottom, each with contacts and plastic, each containing part or the entire port opening, hence reducing the number of added tolerances to a maximum of one or two. By reducing the number of sub-assemblies from three or more to two or less, an easier, more precise manufacturing can be done, with only slightly higher tooling cost. However, due to the fact that it is a high-volume, commodity-type device, the higher tooling costs would be more than offset by the lower part cost, the better yield, etc. Further, by embedding the contacts in a plastic injection, such problems as metal fatigue, travel, etc., can be controlled much better, improving dramatically the life-cycle time for the port side connectors. For one embodiment of the invention, the controller and associated memory device are integrated into the adapter, rendering the adapter a complete card reader.

For one embodiment, a light pipe may be locked in place between the two half shells to conduct light from a signal lamp (e.g., LED) on the PCB to the user side of the opening, similar to networking lights sometimes integrated into networking connectors.

For one embodiment, the straddle-mount configuration is replaced with a surface mounted standard connector. This reduces the manufacturing costs and complexities associated with the straddle-mount configuration.

For one embodiment of the invention, the controller and associated memory device are integrated into the adapter rendering the adapter a complete card reader.

Embodiments of the present invention have been described in reference to flash media such as xD, standard MMC/SD, standard Memory Stick, SmartMedia, miniSD, RSMMC, and MMC/SD, and MS Duo. In general, embodiments of the invention are applicable to any generic flash media.

While the invention has been described in terms of several embodiments, those skilled in the art will recognize that the invention is not limited to the embodiments described, but can be practiced with modification and alteration within the spirit and scope of the appended claims. The description is thus to be regarded as illustrative instead of limiting.

The invention claimed is:

1. A multi-flash-card reader comprising:

a plurality of connectors (62, 64, 66, 68) each having a respective slot adapted to removably receive a flash memory card;

characterised by comprising a converter chip (40) connected to the connectors and adapted to convert signals from a flash-memory card currently inserted in one of said connectors to read data from the flash-memory card;

the converter chip having an interface (100) for outputting data read from the flash-memory card;

the plurality of connectors comprising at least first and second connectors (64;62), the first connector (62) having a parallel data bus and control signals for parallel data transfer from a type of flash-memory card providing parallel data access in which a parallel data bus and an address bus are used to access data, hereafter referred to as a parallel card (16), and the second connector (64) having at least one serial data pin and a clock pin for controlling serial data transfer from a type of flash-memory card, hereafter referred to as a serial card (28), in which one or more data lines are each clocked in synchronization with a clock signal so that one bit or one word of data is transferred for each clock;

wherein the converter chip is adapted to control clocked data transfer for serial cards and parallel data bus transfer for parallel cards, whereby multiple types of flash-memory card can be read by the multiflash-card reader using the converter chip;

the converter chip further comprising a shifter (98) connected to data and clock signals (DATA; CLK)

from the second connector and adapted to clock in one bit of data for each clock pulse when the serial card (28) is of a first type providing bit by bit data access and to clock in one word of data for each clock pulse when the serial card (26) is of a second type providing word by word data access.

2. A multi-flash-card reader as claimed in claim 1 wherein the first type of serial card is a MultiMediacard and wherein the second type of serial card is a Secure Digital Card.

3. A multi-flash-card reader as claimed in any preceding claim wherein the shifter further comprises means for performing a cyclical redundancy check, CRC, on the data to detect errors.

4. A multi-flash-card reader as claimed in claim 1 wherein the plurality of connectors further comprises a third connector (66) connected to the converter chip and having a parallel data bus and control signals for controlling parallel data transfer from a parallel card of a second type removably inserted in the third connector.

5. A multi-flash-card reader as claimed in claim 4 wherein the plurality of connectors comprises a fourth connector having a serial data pin and a clock pin for controlling serial data transfer from a serial card of a third type removably inserted in the fourth connector.

6. A multi-flash-card reader as claimed in claim 5 wherein the first connector is adapted to receive the parallel card comprising a CompactFlash card, the second connector is adapted to receive a serial card comprising anyone of a first type being a MultiMedia card and a second type being a Secure Digital card; the third connector is adapted to receive the second type of parallel card being a Smart Media card; and the fourth connector is adapted to receive a third type of serial card being a Memory Stick card.

7. A multi-flash-card reader as claimed in claim 1 wherein the interface is adapted to connect to a host computer via an external cable.

8. A multi-flash-card reader as claimed claim 1 wherein the interface is adapted for connection to a host via a cable which is internal relative to a housing of the multi-flash-card reader.

9. A multi-flash-card reader as claimed in claim 1 wherein the plurality of connectors each have card detect signals for detecting the presence of a flash memory card inserted into said connector;

wherein the converter chip is adapted to sense a voltage change in the card detector signals from a connector and to activate a routine to access the flash memory card activating the card detect signals, whereby flash memory cards are detected by the converter chip.

* * * * *